US009636602B1

(12) United States Patent
Samo et al.

(10) Patent No.: US 9,636,602 B1
(45) Date of Patent: May 2, 2017

(54) BUILDING COMPONENTS

(71) Applicant: Mattel, Inc., El Segundo, CA (US)

(72) Inventors: Jebraeil Samo, Rowland Heights, CA (US); Kevin Kai Cao, Reseda, CA (US)

(73) Assignee: Mattel, Inc., El Segundo, CA (US)

( * ) Notice: Subject to any disclaimer, the term of this patent is extended or adjusted under 35 U.S.C. 154(b) by 67 days.

(21) Appl. No.: 14/164,814

(22) Filed: Jan. 27, 2014

(51) Int. Cl.
*A63H 17/00* (2006.01)
*A63H 33/08* (2006.01)

(52) U.S. Cl.
CPC ..... *A63H 33/086* (2013.01)

(58) Field of Classification Search
CPC ..... A63H 17/00
USPC ..... 446/93
See application file for complete search history.

(56) References Cited

U.S. PATENT DOCUMENTS 2,072,374 A * 3/1937 Manoil ..... A63H 17/26 446/470
2,510,310 A * 6/1950 Francis ..... A63H 17/00 446/469
3,280,500 A * 10/1966 Fairbairn ..... A63H 17/00 446/466
3,662,488 A * 5/1972 Linstead ..... 446/428
3,711,989 A * 1/1973 Nielsen ..... A63H 17/262 446/469
3,740,895 A * 6/1973 Nagasaka ..... 446/95
4,183,173 A * 1/1980 Ogawa ..... A63H 33/003 446/279
4,463,515 A * 8/1984 Barlow ..... A63H 29/20 446/409
4,485,587 A * 12/1984 Barlow et al. ..... 446/442
4,631,040 A * 12/1986 Shiraishi ..... 446/95
4,690,656 A * 9/1987 Friedman ..... A63H 33/042 446/424
D345,398 S * 3/1994 Plagborg ..... D21/485
D371,400 S * 7/1996 Host ..... D21/495
5,743,779 A * 4/1998 Nielsen ..... 446/93
5,919,072 A * 7/1999 Pohlman ..... 446/95
6,910,939 B2 * 6/2005 Hui ..... 446/93
6,957,996 B2 * 10/2005 Hui ..... 446/93
7,329,166 B2 * 2/2008 Hatting et al. ..... 446/93
(Continued)

*Primary Examiner* — Aarti B Berdichevsky
*Assistant Examiner* — Dolores Collins
(74) *Attorney, Agent, or Firm* — Edell, Shapiro & Finnan, LLC

(57) ABSTRACT

The building components of the present invention provide building components which are compatible with high-stress and/or high-impact devices or mechanisms due to at least their composition or their configuration. Consequently, the building components of the present invention provide a more robust building component. In some embodiments, the building components of the present invention are be die-cast, metal building components manufactured from any desirable metal, such as zinc. Alternatively or additionally, the building components may include a configuration that provides for at least one offset coupling configuration such that building components may be coupled together in a structurally secure configuration. Thus, in some embodiments, the building components of the present invention provide a building component for constructing toy vehicles that is compatible with wheeled boosters typically provided for die cast toy vehicles.

15 Claims, 8 Drawing Sheets

(56) References Cited

U.S. PATENT DOCUMENTS

| | | | | |
|---|---|---|---|---|
| 7,387,559 | B2 * | 6/2008 | Sanchez-Castro | A63H 17/14 446/433 |
| 7,803,030 | B2 * | 9/2010 | Nagaoka | 446/93 |
| 8,534,394 | B2 * | 9/2013 | Lin | 180/2.2 |
| 8,790,150 | B2 * | 7/2014 | Truckai | 446/73 |
| 8,790,151 | B2 * | 7/2014 | Bertrand et al. | 446/85 |
| 2008/0254707 | A1 * | 10/2008 | Amadio et al. | 446/93 |

* cited by examiner

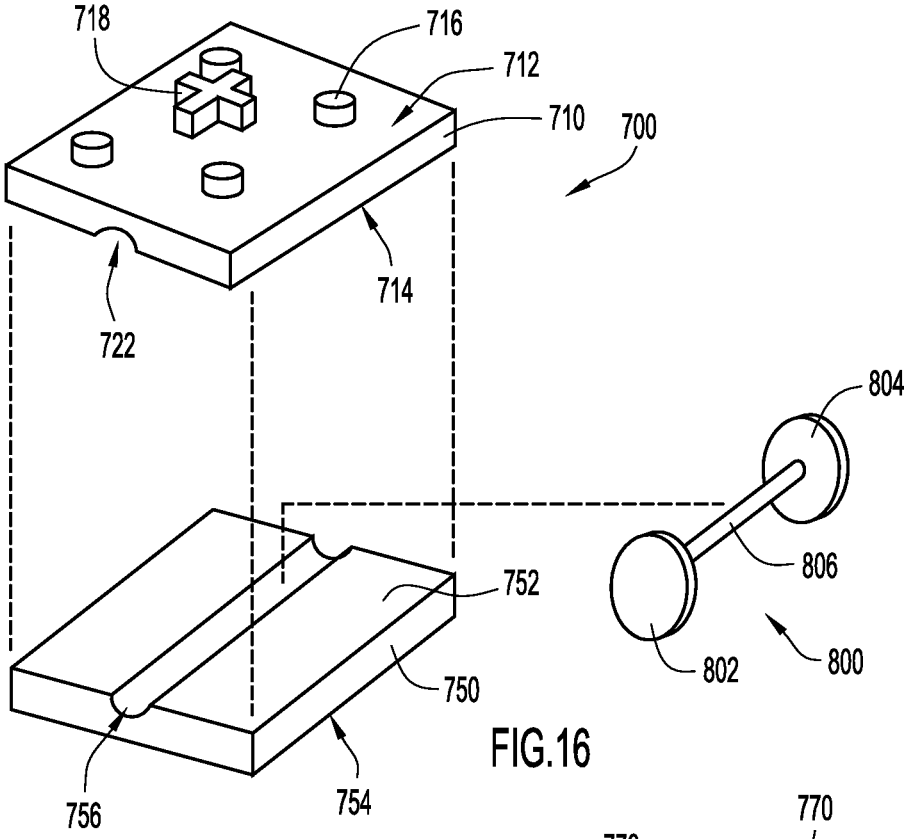
FIG.16
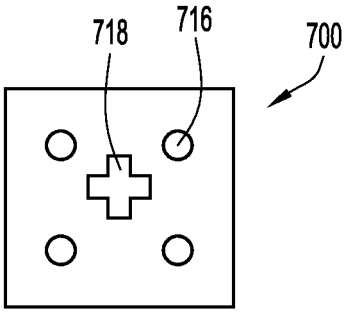
FIG.17
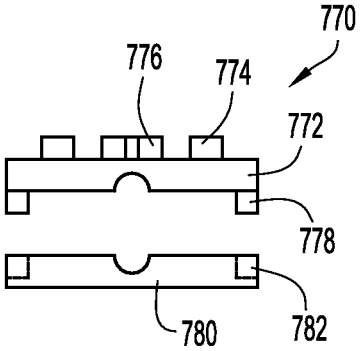
FIG.18
FIG.19
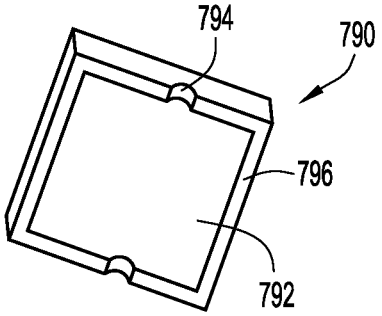

BUILDING COMPONENTS

FIELD OF THE INVENTION

The present invention relates to building components. More specifically, the present invention relates to building components which are compatible with high-stress and/or high-impact devices or mechanisms due to at least their composition or their configuration.

BACKGROUND OF THE INVENTION

Building blocks, and in particular building blocks with coupling portions are well known and widely popular among children. Some conventional blocks have a body that includes an upper portion and several walls that extend downwardly from the upper portion. The downwardly extending walls define a cavity or aperture therebetween. Typically, one or more studs extend from the upper portion of the block. The cavity or aperture defined by the walls is sized to receive the studs of another block so that a user may stack or build multiple blocks on top of each other to create various assemblies. For example, children may typically couple multiple blocks together to build or create toy vehicles. Generally, the studs of a first block are inserted into an aperture or cavity of a second block in order to stack or build the first and second blocks or otherwise couple them together.

More specifically, conventional blocks that are coupled to each other are retained in a coupled arrangement by the friction between the outer surfaces of the stud or studs of one block and the walls and other surfaces of another block with which the studs are in contact. The outer side surface or surfaces of a stud are perpendicular to the upper portion of the block from which they extend. Similarly, the walls or surfaces of a block that are engaged by a stud are perpendicular to the upper portion of that block. The perpendicular orientations of the surfaces of the studs and the walls allow the studs to be inserted into the cavity or aperture, with the contact surfaces sliding along each other, but also limit the manner in which blocks can be coupled together.

Due to this, a portion of a first block must be vertically aligned with at least a portion of a second block in order to couple the first and second blocks together. Thus, conventional blocks cannot be coupled to each other in laterally adjacent configurations (i.e. configurations where at least a portion of a first block is laterally adjacent to a second block while also coupled to the second block). Among other restrictions caused by this limitation, if a building block is utilized as a chassis for a toy vehicle, the wheels will be required to extend beneath the building block, instead of being included substantially within the chassis, thereby limiting the structural strength, design, and stability of a toy vehicle constructed from building blocks. Accordingly, a building component which provides for at least one laterally adjacent coupling is desired.

Additionally, to ensure that blocks may be coupled together in the manner described above, such blocks must be manufactured with very high tolerances for the surfaces of the studs and walls because if either of the walls or surfaces varies from the perpendicular orientation, the friction between them will be insufficient to retain the blocks together. In order to obtain this tolerance at a reasonable cost, conventional blocks are typically manufactured from plastic and plastic-like materials. However, while plastic may enable cheaper manufacturing costs, plastic building blocks are not sturdy enough to absorb repeated stresses and strains imparted thereon and thus, may deteriorate over time when exposed to such forces. For example, conventional, plastic blocks may be unable to absorb the repeated stress imparted onto a toy vehicle constructed from conventional blocks from a toy vehicle booster, such as the toy boosters disclosed in U.S. Pat. Nos. 8,366,508 and 6,793,554, the disclosures of which are each hereby incorporated in their entireties. Accordingly, building blocks, and in particular building components which may be used to build toy vehicle assemblies, manufactured from more robust materials, such as zinc, are desired.

SUMMARY

According to at least one embodiment of the present invention, a building component includes a main body with a first flange, a second flange, a central portion, at least one coupler, and at least one receiving area. The first flange includes a first elevated portion and a first elongate member and the second flange includes a second elevated portion and a second elongate member. The central portion includes a first end and a second end, the first flange being coupled to the first end of the central portion via the first elongate member such that the first elevated portion is disposed at a distance above the central portion and the second flange being coupled to the central portion via the second elongate member such that the second elevated portion is disposed at a distance above the central portion so that the first and second elevated portions being parallel with the central portion. The at least one coupler is included on a top surface of the main body and the at least one receiving area is included on a bottom surface of the main body, such that the receiving area is configured to receive a coupler of a second building component to couple the building component to the second building component.

In some embodiments of the above building component, the building component also includes an aperture included in one of the first flange, the second flange, or the central portion. In some of these embodiments, the aperture is located centrally in a two by two cluster of couplers. In yet other embodiments, the aperture is cross-shaped. In some embodiments where the aperture is cross-shaped, each of the first flange, the second flange and the central portion includes a cross-shaped aperture. In some of these embodiments, the cross-shaped apertures is located in the middle of a set of four couplers. Furthermore, in some embodiments of the above building component, the building component is formed of a zinc alloy.

According to another embodiment of the present invention, a toy building component includes a main body having a top surface, a bottom surface opposite the top surface, a stud coupled to the top surface, and a receiving area defined in the bottom surface. The receiving area is configured to receive a second stud of a building member to couple the building component to the building member, and the main body and the stud on the top surface are die cast from a metal or metal alloy.

In some embodiments of the above toy building component, the building component is die cast and formed of zinc. In some of these embodiments, the building component is coupleable to plastic blocks.

According to yet another embodiment of the present invention, a toy vehicle constructed from building components includes a chassis, a first wheel assembly, and a second wheel assembly. The chassis includes a main body with at least one stud extending from a top surface of the chassis and at least one receiving area included in a bottom surface of the chassis. The first wheel assembly includes at least one stud extending from a top surface of the first wheel assembly. The second wheel assembly also includes at least one stud extending from a top surface of the second wheel assembly. The studs of the first and second wheel assemblies are received in the at least one receiving area of the chassis to couple the first and second wheel assemblies to the chassis and the first and second wheel assemblies are laterally aligned with the chassis when coupled thereto.

In some embodiments of the above toy vehicle constructed from building components, the toy vehicle is configured for repeated use with wheeled boosters. In other embodiments, the chassis is a die cast building component. Some of these die cast embodiments are die cast and formed of zinc.

In other embodiments of the above toy vehicle constructed from building components, the chassis also includes an aperture and at least one of the first and second wheel assemblies also includes a connector extending upwards from the top surface of the wheel assembly, the aperture being configured to receive the connector. In some of these embodiments, the connector and aperture are each cross-shaped. In some of these embodiments, any part of the connector extending above the top surface of the chassis is configured to be secured within a building block coupled to the top surface of the chassis above the aperture. For example, in some embodiments, the building block includes an annular interior wall extending downwardly from a bottom surface of the building block and the connector is configured to be secured within the annular interior wall when the studs of the chassis are secured around the interior wall.

In other embodiments of the above toy vehicle constructed from building components, the chassis provides at least one offset coupling configuration. For example, in some embodiments, the chassis includes a main body with a first flange including a first elevated portion and a first elongate member, a second flange including a second elevated portion and a second elongate member, and a central portion including a first end and a second end. The first flange is coupled to the central portion via the first elongate member such that first elevated portion is disposed at a distance above the central portion, the second flange is coupled to the central portion via the second elongate member such that the second elevated portion is disposed at a distance above the central portion, and the first and second elevated portions are parallel with the central portion.

BRIEF DESCRIPTION OF THE DRAWINGS

FIG. 16 shows an exploded view of perspective view an embodiment of a wheel mounting component.

FIG. 17 shows a top view of the wheel component of FIG. 16.

FIG. 18 shows an exploded side view of another embodiment of a wheel mounting wheel mounting component.

FIG. 19 shows a bottom perspective view of another embodiment of a wheel mounting component.

Like reference numerals have been used to identify like elements throughout this disclosure.

DETAILED DESCRIPTION OF THE INVENTION

Figure 1A:
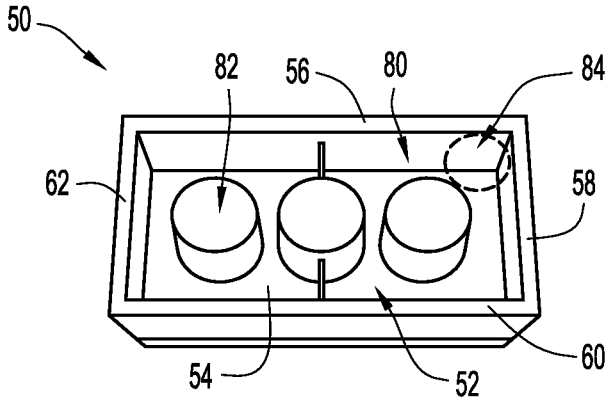
FIGS. 1A-B show bottom and side perspective views, respectively, of an exemplary embodiment of a building component constructed from a robust material, in accordance with the present invention.

Generally referring to the figures, several exemplary embodiments of building components in accordance with the present invention are shown. As discussed below in further detail, the building components of the present invention are, among other benefits, compatible with high-stress and/or high-impact devices or mechanisms due to at least their composition or their configuration. In other words, the building components of the present invention may provide a robust building component. For example, in some embodiments, the building components of the present invention may provide a building component for constructing toy vehicles and the completed toy vehicle be compatible with wheeled boosters that are typically provided for die cast toy vehicles, such as the boosters disclosed in U.S. Pat. Nos. 8,366,508 and 6,793,554.

In some embodiments, the building components of the present invention may be compatible with high-stress and/or high-impact devices or mechanisms because the building components may be die-cast, metal building components manufactured from any desirable metal, such as zinc. Alternatively or additionally, the building components may include a configuration that provides for at least one laterally adjacent coupling such that building components may be coupled together in a structurally secure configuration. As seen in FIGS. 3-13, such a configuration may be substantially U-shaped and this configuration may be alternately referred to as a "chassis configuration" or simply "chassis."

In addition to the above features, each building component of the present invention may include one or more projecting portions or studs and/or one or more receiver or receiving areas that are configured to receive a stud included on another building component. The projecting portions or studs may be referred to alternatively as posts or couplers.

Moreover, in some implementations, the building components of the present invention may also include receptacles, apertures, and/or connectors and a receptacle or an aperture included on a first component may be configured to securely receive a connector included on a second building component in order to couple the first block to the second block, either in lieu of or in addition to the coupling provided by the studs and receivers.

Still referring generally to the figures, the quantity of receptacles, receivers, connectors and studs included on a building component can vary, depending on the shape, size, and configuration of the building component. It is to be understood that any desirable arrangement of receptacles, receivers, apertures, connectors, and studs may be included on a building component. In fact, some embodiments may include no studs, apertures, connectors, receivers or receptacles, if desired. In the embodiments which include studs and/or receiving areas, the studs and/or receiving areas may be arranged in one or more rows on any desirable surface of the building component, depending on the width of the surface of that building component. For example, the studs may arranged be in a 2 by 8 grid. Alternatively, the studs may be arranged in a 2 by 3 grid or a 1 by 2 grid, depending on the shape and size of the building component. In embodiments which include studs and receiving areas, the arrangement and quantity of receiving areas preferably mirrors or matches the arrangement of studs on that particular building component.

Figure 1B:
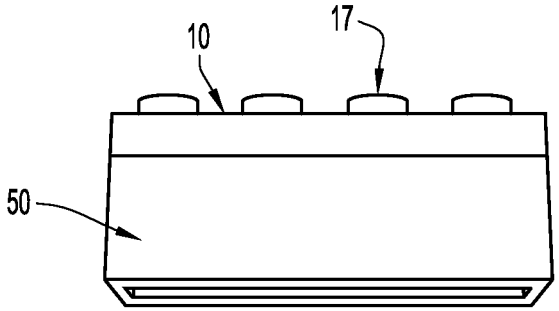

Now referring to FIGS. 1A-B, one exemplary building component 50 is shown from bottom and side perspective views, respectively, with a conventional building block 10 coupled to the top of building component 50. The building component 50 is one exemplary embodiment of a building component manufactured from metal in accordance with the present invention. In this particular embodiment, building component 50 is die cast from a zinc alloy. However, in other embodiments, building component 50 may be manufactured in any desirable manner from any desirable metal or alloy, such as aluminum, magnesium, copper, lead, or some combination thereof, provided that the building component is robust enough to absorb repeated stresses and forces from high impact devices, such as wheeled boosters for toy vehicles. In addition, the metal or alloy material of the chassis provides a certain amount of weight or heft that is useful when using a toy vehicle with a booster. In other words, the weight or heft is useful to maintain the momentum imparted to the toy vehicle by the booster as the toy vehicle exits a booster.

Regardless of the method and material used to manufacture a building component in accordance with the present invention, a metal building component, such as building component 50, may be compatible with and coupleable to building blocks (i.e. blocks manufactured from plastic), as shown in FIGS. 1A-B and as described in detail below.

As shown in FIGS. 1A-B, building component 50 includes a main body 52 with a top or an upper portion 54 and several side walls 56, 58, 60, and 62 extending downwardly from the main body 52. The building component 50 may also include at least one interior wall 82 extending downwardly from the top portion 54 of main body 52. Together, side walls 56, 58, 60, and 62 collectively define a cavity 80 and the at least one interior wall 82 may extend through a central portion of cavity 80. Collectively, the at least one interior wall 82 and sidewalls 56, 58, 60, 62 form receiving areas 84 in cavity 80, into which a stud or post from another building component may be inserted. In FIG. 1A, one such receiving area 84 is shown in hashed lines with the understanding that this receiving area 84 is representative of multiple receiving areas included in cavity 80.

Additionally, although not shown, building component 50 also includes at least one projecting portion or stud extending upwardly from the upper surface 54 of the main body 52. As seen in FIG. 1B, building block 10 may also include studs or posts 17, and typically, the studs of building component 50 may resemble studs 17, at least in shape, but in other embodiments, the studs may be shaped as desired.

Although the building component 50 is shown as a rectangular parallelepiped in FIGS. 1A-B, in various embodiments, the body 52 of the building component 50 may have any type of shape, size, or configuration. For example, a building component 50 may have a generally flat configuration. Alternatively, a building component 50 may have a configuration that generally resembles a cube. Also, in some embodiments, a building component 50 may have a configuration that is not a standard geometric shape. For example, a building component 50 may be a portion of a building (such as a toy window, door, door frame, etc.) or a toy vehicle (an axle supporting structure, car window, a hood, a trunk, etc.) or other product.

Additionally, it is to be understood that in various embodiments, building component 50 may include one stud, two studs, or any desirable grid arrangement of posts extending from the body 52. Similarly, it is to be understood that in various embodiments, the body 52 of the building component 50 may include one receiver or receiving area 84 formed in the body 52 that defines a single receiver or receiving area. Alternatively, in different embodiments, the receiver 84 may be defined or formed into more than one receiver or receiving area, each of which is configured to receive a stud from another building component. In other words, provided that that building component 50 is primarily manufactured from metal, it may have any desirable shape or configuration and still provide the benefits associated with a more robust building component that is compatible with high impact devices and mechanisms, such as wheeled booster wheels.

Figure 2:
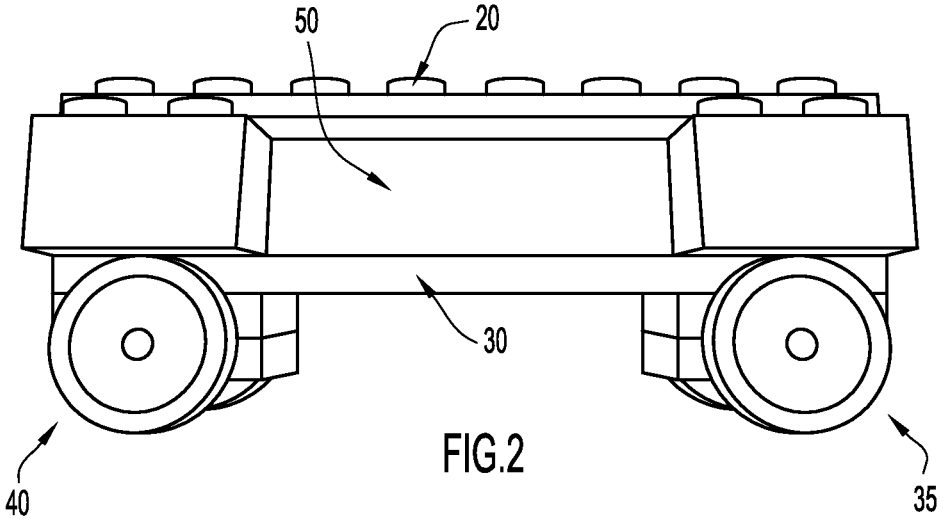
FIG. 2 shows a side view of the exemplary embodiment shown in FIGS. 1A-B with building blocks coupled thereto.
Figure 3:
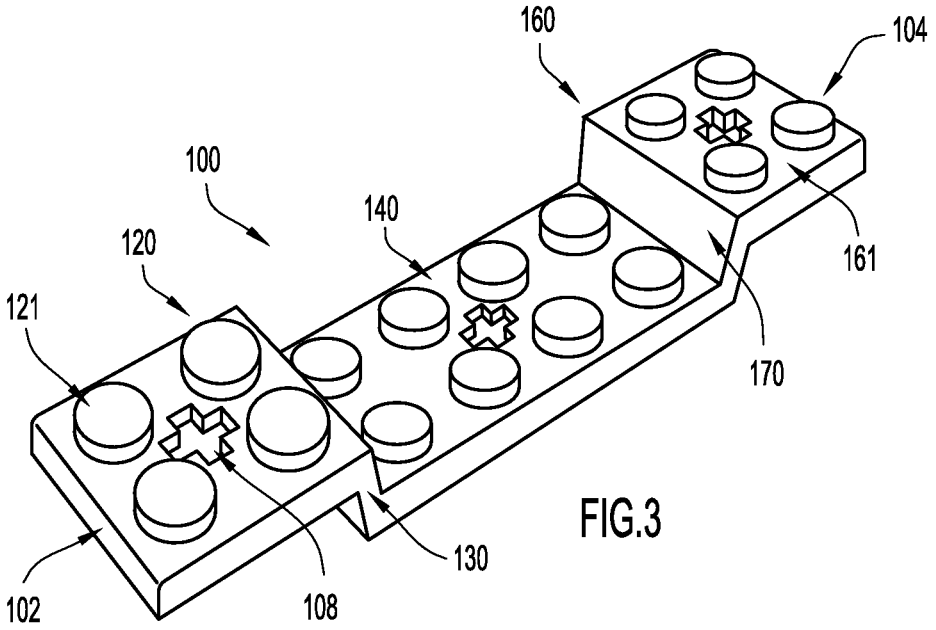
FIG. 3 shows a perspective view of an exemplary embodiment of a building component which provides laterally adjacent couplings, in accordance with the present invention.

Now turning to FIG. 2, the building component 50 is shown coupled to an assortment of building blocks, including blocks 20 and 30 and wheel blocks 35 and 40. Generally, in order to couple a building component to another building component or block, the male studs of a first block/component may be inserted into the female receiving areas of the cavity of a second block/component and secured between some combination of internal walls and sidewalls. Thus, once a building component is at least partially vertically aligned with another component or a block, the two building components may be moved towards each other in order to effectuate a coupling. In the particular embodiment shown in FIGS. 1A and 1B, each of the studs of building component 50 was aligned with each of the receiving areas of block 10 (not shown but substantially similar to receiving areas 84) and then the blocks were moved together in order to insert and engage the studs with the receiving areas to couple block 10 to component 50. Component 50 is coupled to an assortment of blocks in FIG. 2 in the same manner.

As mentioned above and shown in FIG. 2, blocks can be coupled to a building component 50 either adjacent its top surface by inserting the studs of building component 50 into the receiving areas of the building block (i.e. block 20) or adjacent the lower edges of walls 56, 58, 60, and 62 by inserting the studs of a building block (i.e. block 30) into the receiving areas 84 of building component 50 (see FIG. 1A). Thus, the building component 50 may be incorporated into various assemblies as desired. In this particular embodiment, the building component 50 has been incorporated into a toy vehicle. However, since each of the blocks 20, 30 is rectangular, the wheel blocks 35, 40 can only be coupled to the blocks 30, 40 above or below the blocks and, thus, extend below block 30. Due to this configuration, any lateral forces exerted on wheels 35, 40 may cause the wheels to fold inwards, outwards or otherwise become decoupled from the toy vehicle.

Now turning to FIGS. 3-10B, another building component 100, which may be alternately referred to as U-shaped component 100 or chassis 100 is shown and may be manufactured from metal, preferably by die casting component 100 from zinc or a zinc alloy. Building component 100 is substantially U-shaped, insofar that it includes one or more offset surfaces connected by walls perpendicular to the offset surfaces. In other words, building component 100 provides laterally adjacent couplings which, among other benefits, allow wheel bases to be coupled thereto laterally adjacent to at least at portion of component 100 such that they are coupled to component 100 with additional stability as compared to the coupling provided by a building block. Thus, even in embodiments which are not manufactured from metal, component 100 may provide a configuration which is more suitable for repeated interaction with a wheeled booster and other high impact devices. In particular, building component 100 may provide a chassis for small toy vehicles which allows the wheels to be vertically aligned with the chassis (as opposed to extending therebeneath) and, thus, provides a stable chassis for building a toy vehicle from building components, blocks, or some combination thereof.

Referring now to FIGS. 3-7, the chassis 100 is shown from various perspective views. As can be seen, the chassis extends from a first end 102 to a second end 104 and includes a central portion 140 which extends between a first flange 120 that is adjacent to first end 102 and a second flange 160 that is adjacent to second end 104. Each flange 120, 160 has a substantially inverted-"L" shape, such that each flange 120, 160 includes an elevated portion or plate 121, 161 and a connector or elongate member 130, 170 which couples the elevated portions 121, 161 to the central portion 140 of chassis 100, respectively. Preferably, the elongate members 130, 170 are perpendicular to both the central portion 140 and their respective elevated portions 121, 161 such that the elongate members 130, 170 are substantially vertical and the elevated portions 121, 161 are parallel to the central portion 140.

Figure 4:
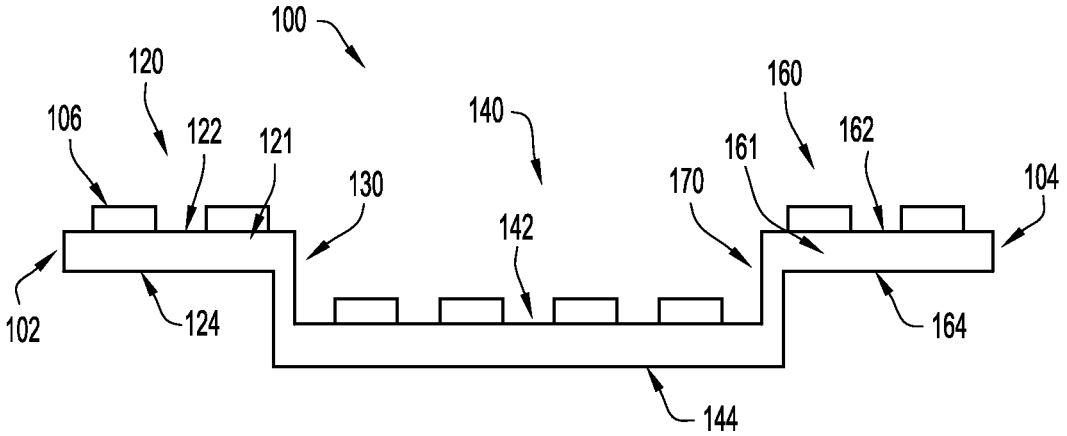
FIG. 4 shows a side view of the exemplary embodiment shown in FIG. 3.

Additionally, each of the elevated portions or plates 121, 161 and the central portion 140 includes studs or posts 106. In some embodiments, the elongate members 130, 150 may also include studs 106 but, preferably, these portions of chassis 100 do not include any studs 106. More specifically, and as best seen in FIG. 4, the first elevated portion 121 extends from a bottom surface 124 to a top surface 122 while the second elevated portion 161 extends from a bottom surface 164 to a top surface 162 and each of the top surfaces 122, 162 includes a two by two grid of studs 106. Similarly, the central portion extends from a bottom surface 144 to a top surface 142 which includes a grid of studs 106, but, in this embodiment, the central portion 140 includes a four by two gird of studs. Due to this configuration, the chassis 100 may be considered to have a two by eight grid of studs 106, as seen best in the top view of FIG. 6.

Figure 5:
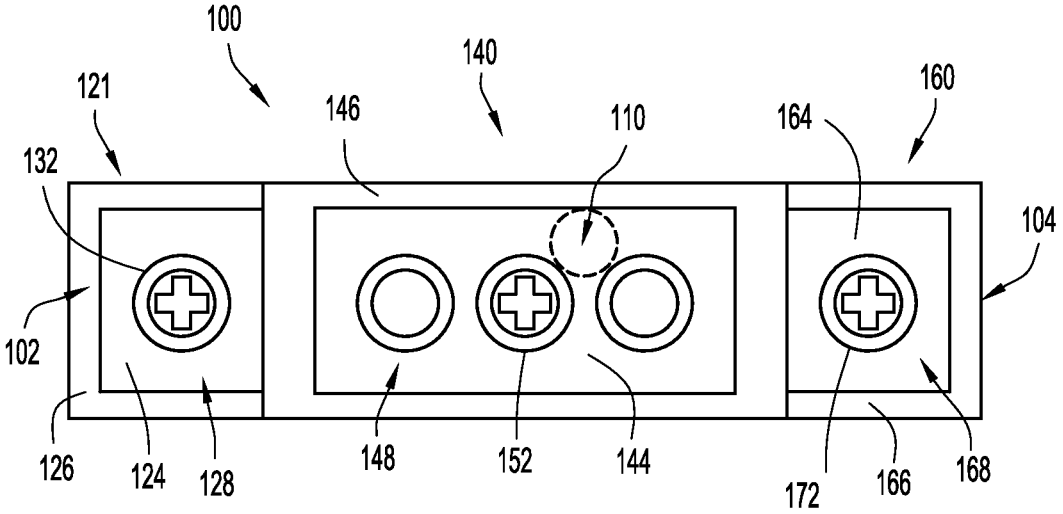
FIG. 5 shows a bottom view of the exemplary embodiment shown in FIG. 3.
Figure 6:
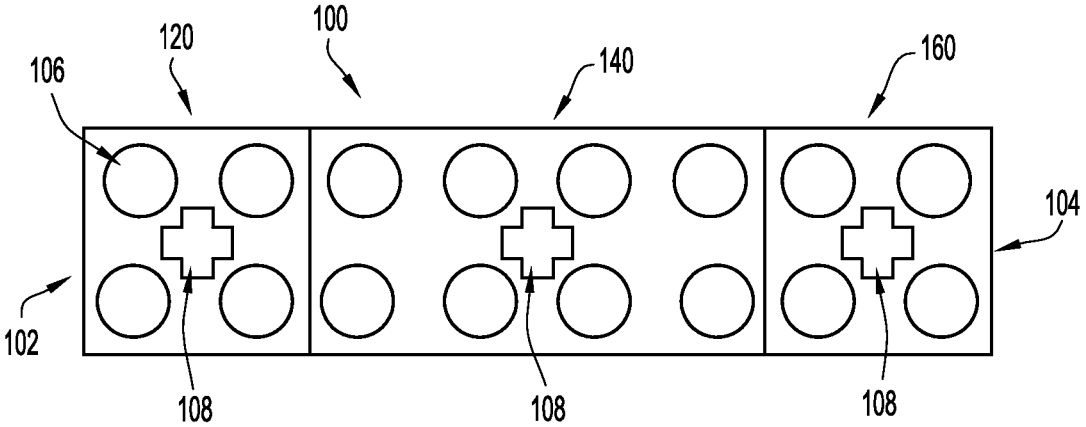
FIG. 6 shows a top view of the exemplary embodiment shown in FIG. 3.
Figure 7:
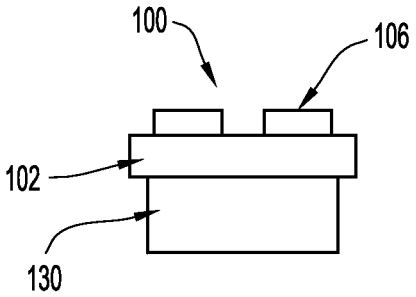
FIG. 7 shows a front view of the exemplary embodiment shown in FIG. 3.

Still referring to FIGS. 3-7, but with particular attention to FIG. 5, chassis 100 also includes receivers on the bottom surfaces 124, 164, and 144 of the elevated portions 121, 161 and central portion 140, respectively. Similar to building component 50, each of the elevated portion 121, elevated portion 161, and central portion 140 includes a sidewall that extends downward to from the respective top surface 122, 162, 142 of that portion to create a cavity 128, 168, 148 in which receiving areas may be formed. In particular, first elevated portion 121 includes a sidewall 126 that extends downwardly from lower surface 124 to form a cavity 128, second elevated portion 161 includes a sidewall 166 that extends downwardly from lower surface 164 to form a cavity 168, and central portion 140 includes a sidewall 146 that extends downwardly from lower surface 144 to form a cavity 148.

Within each cavity 128, 148, 168, an interior wall 132, 152, 172 also extends downwardly from its respective lower surface 124, 144, 164 in order to form receiving areas 110, one of which is shown in hashed lines in central portion 140 with the understanding that this receiving area 110 is representative of the receiving areas included in each of cavities 128, 148, 168. As explained above, each receiving area 110 is configured to receive a stud 106 in order to allow building component 100 to be coupled to other building components and/or blocks. Moreover, in this particular embodiment, each of the interior walls 132, 152, 172 is an annular wall in order to provide additionally couplings or coupling features. In particular, in some embodiments, an aperture 108 (see FIG. 6) may be included within the interior walls 132, 152, 172 which may be configured to receive a connector included on other building components, as will be described in detail below. In this particular embodiment, each of portions 121, 161 and central portion 140 includes one aperture 108. As shown, the aperture 108 is configured to receive an X-shaped connector from another building component, as discussed in greater detail below.

Now turning to FIGS. 8-10B, the chassis 100 is shown with building block 300 and wheel bases or wheel assemblies 210, 240 coupled thereto. As discussed above, building block 300 may be coupled to a building component, such as chassis 100, by simply aligning and engaging at least some of the studs and receivers of the component and block, or vice versa. In this particular embodiment, the receiving areas of block 300 are engaged by the two by four grid of studs 106 included on central portion 140 of chassis 100. As is shown, when block 300 is situated over an aperture 108, the aperture 108 has no impact on the coupling.

In contrast, the wheel bases 210, 240, which each include a set of wheels 214, 246 rotatably coupled to its respective main body 212, 242, are coupled to the underside of chassis 100. In order to facilitate this coupling, the main body 212, 242 of each wheel base 210, 240 includes studs (not shown), as well as connectors 218, 248, extending upwards from a top surface of its respective main body 212, 242. Thus, in order to couple the wheel bases 210, 240 to the chassis 100, the studs of the wheel bases 210, 240 must be engaged with the receiving areas 110 of the elevated portions 121, 161 and the connectors 218, 248 must be aligned with and inserted through the apertures 108 included in each elevated portion 121, 161.

Figure 8:
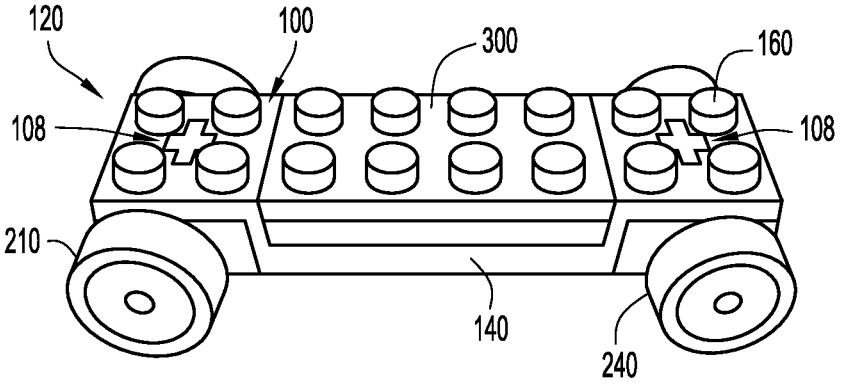
FIG. 8 shows a perspective view of the building component of FIG. 3 with additional building components attached thereto.
Figure 9:
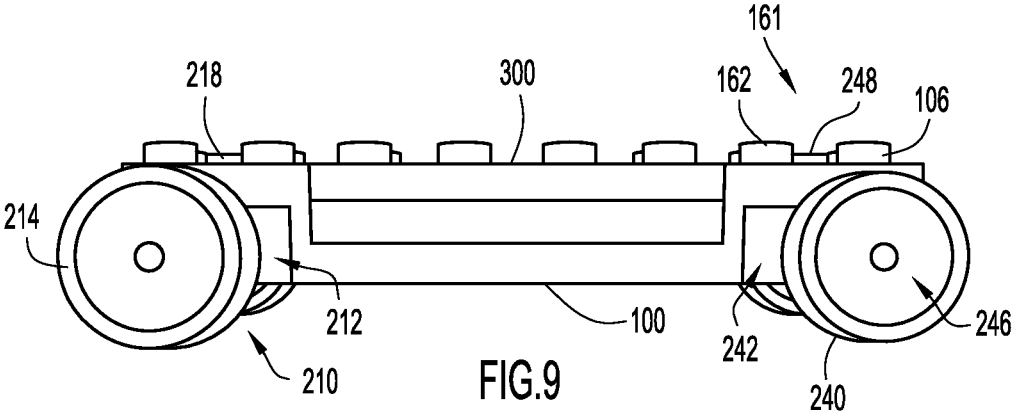
FIG. 9 shows aside view of the exemplary embodiment shown in FIG. 8.
Figure 10A:
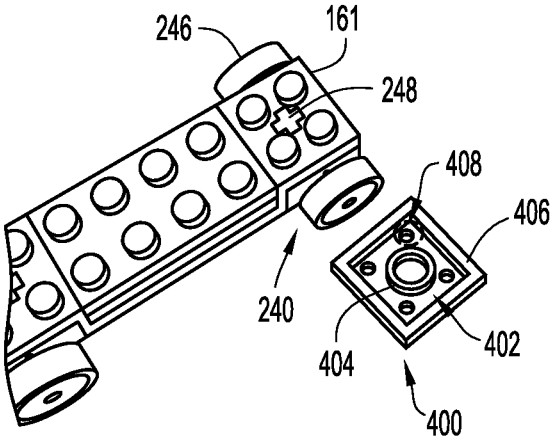
FIGS. 10A-B show perspective view of the exemplary embodiment of FIG. 8 with a building block being coupled thereto.
Figure 10B:
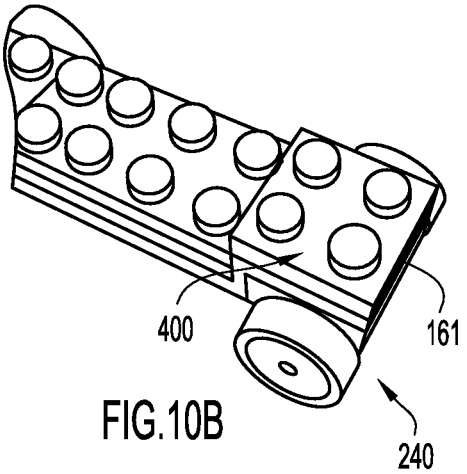

In this particular embodiment, and as best seen in FIGS. 8 and 9, the apertures 108 are substantially "X-" or cross-shaped and the connectors 218, 248 are similarly shaped so the connectors 218, 248 may mate with the apertures 108. This shape provides an additional coupling which resists rotation with respect to the central axis of the connector and thus, further, increases the stability of the coupling between wheels 214, 246 and 100. However, in other embodiments, the apertures 108 and connectors 218, 248 may have any desirable shape or configuration which further effectuates a coupling between the wheel bases 210, 240 and the chassis.

In still further embodiments, the chassis 100 may not include any apertures 108 (and the wheel bases 210, 240 may not include connectors 218, 248) if desired. As shown, each of the cross-shaped apertures is located in the middle of set of posts or couplers.

In those embodiments which include apertures 108 and or connectors 218, 248, each of these features is preferably included within or aligned with the interior walls included on the underside of the building component (i.e. walls 132, 152, 172). Additionally or alternatively, apertures 108 and or connectors 218, 248 may be disposed centrally between any cluster of four studs arranged in a two by two grid. Aligning these features in at least one of the aforementioned configurations may ensure that a connector included on a first block may be inserted through an aperture of a second block while the studs of the first block simultaneously engage the receivers of the second block. Additionally, such an alignment may align the connector of the first block with the interior wall of a third block that may be coupled atop of the second block, further securing the first block to the second block. An example of this feature is shown in FIGS. 8-10B.

Specifically, in FIGS. 8-10B, connector 248 is shown inserted through the aperture 108 included in elevated portion 161 such that connector 248 extends above the top surface 162 of the second elevated portion 161 (see FIG. 9). However, as can also be seen in FIG. 9, connector 248 does not extend beyond studs 106. Thus, the connector 248 will not prevent the studs 106 from being received within the receivers of another block or component that includes an annular interior wall. Specifically, in FIG. 10A, a block 400 that includes a receiving area 408 disposed in a cavity 402 between an annular interior wall 404 and sidewall 406 is shown. Since the interior wall 404 is annular, the connector 248 can be received within the interior wall 404 when each of the studs 106 of elevated portion 161 is received within the receiving areas 408. Consequently, block 400 may be coupled to the chassis 100 adjacent the top surface of the chassis and to the wheel assembly 240 at a distance from the wheel assembly 240 (the distance being the thickness of chassis 100). By coupling the wheel assembly 240 to a piece or part disposed above the chassis, such as block 400, the coupling between the assembly 240 and chassis may be further strengthened, as the assembly will be discouraged from being vertically displaced from the chassis 100.

Still referring to FIGS. 8-10B, even disregarding, for the moment, the enhancements provided by the connectors and apertures of the wheel assemblies and chassis, the shape of chassis 100 enables the wheel bases 210, 240 to be coupled to chassis while being laterally aligned with chassis 100. Most notably, chassis 100 provides a single building component which can have wheels coupled thereto in a configuration where the wheel assemblies do not extend beyond the vertical bounds of the chassis 100, thereby securing the wheel assemblies to the chassis in a manner which limits movement of the wheel assemblies with respect to the chassis in at least one degree of freedom (i.e. horizontal or laterally). Specifically, the wheel bases 210, 240 may be shielded from outwardly oriented lateral forces (since the interior of the wheel bases are not exposed) and supported against inwardly oriented lateral forces by the chassis 100 (since the wheel assemblies abut elongate members 130, 150). Thus, the chassis provides a more secure and stable base than a conventional building block simply by way of its shape. However, each of the additional features described above—the X or cross-shaped apertures and connectors which are securable by a third block—each secure the wheel assemblies with respect to at least one additional degree of freedom. Specifically, the shape of the connectors secures the wheel assemblies rotationally and coupling the connectors to a third block secures the wheel assemblies vertically with respect to the chassis.

Now referring to FIGS. 11-15, two embodiments of toy vehicle constructed from building components of the present inventions are shown. As show, any desirable parts of any desirable shape or size may be combined or coupled together in order to create a vehicle with at least some building components of the present invention. Preferably, each vehicle includes a chassis and two wheel bases or assemblies coupled thereto and most preferably, a vehicle constructed from building components of the present invention includes chassis 100, as chassis 100 may allow for the wheel assemblies to be robustly secured to the chassis. Each of the embodiments shown in FIGS. 11-15 are suitable for repeated use with wheeled boosters, as well as other high impact boosters, mechanisms, or devices, such as toy vehicle stunt devices. Additionally, while each of the vehicles shown in FIGS. 11-15 includes various parts and features, it is to be understood that any desirable parts or features may be included in any desirable vehicle.

Figure 11:
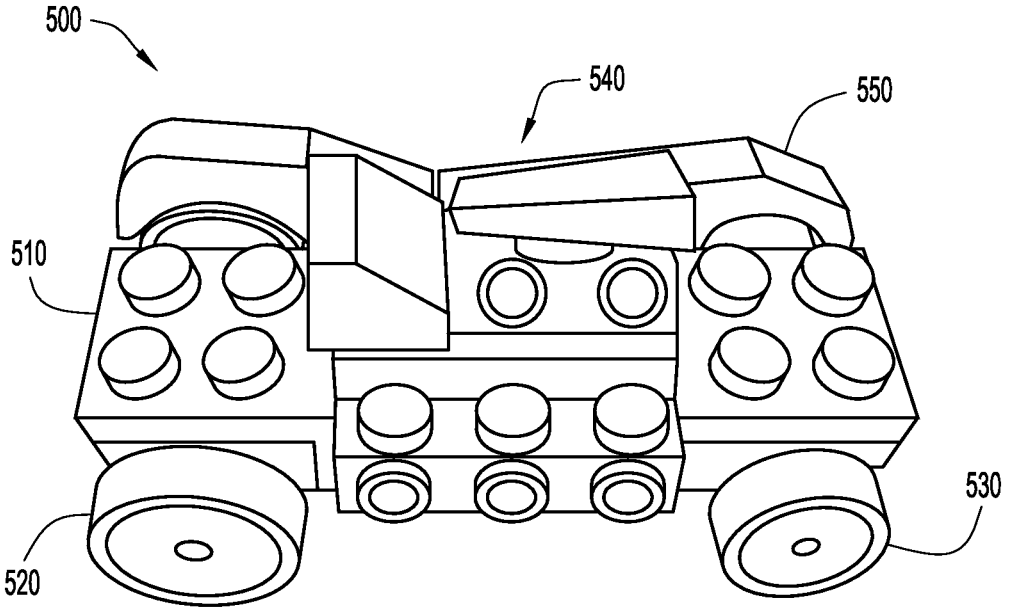
FIGS. 11-12 show top and bottom perspective views, respectively, of an exemplary embodiment of a toy vehicle built from at least one building component of the present invention.
Figure 12:
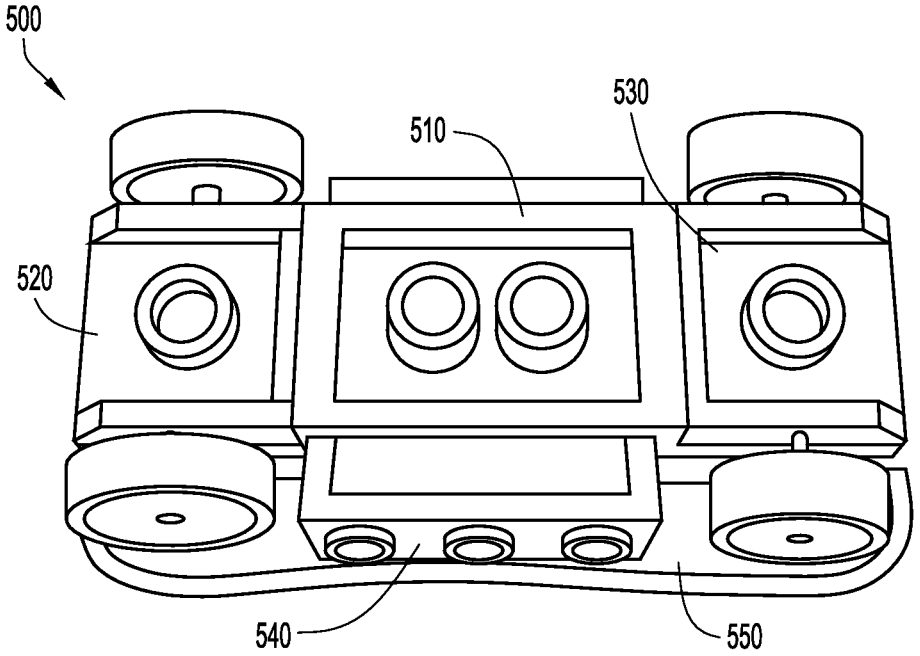
Figure 13:
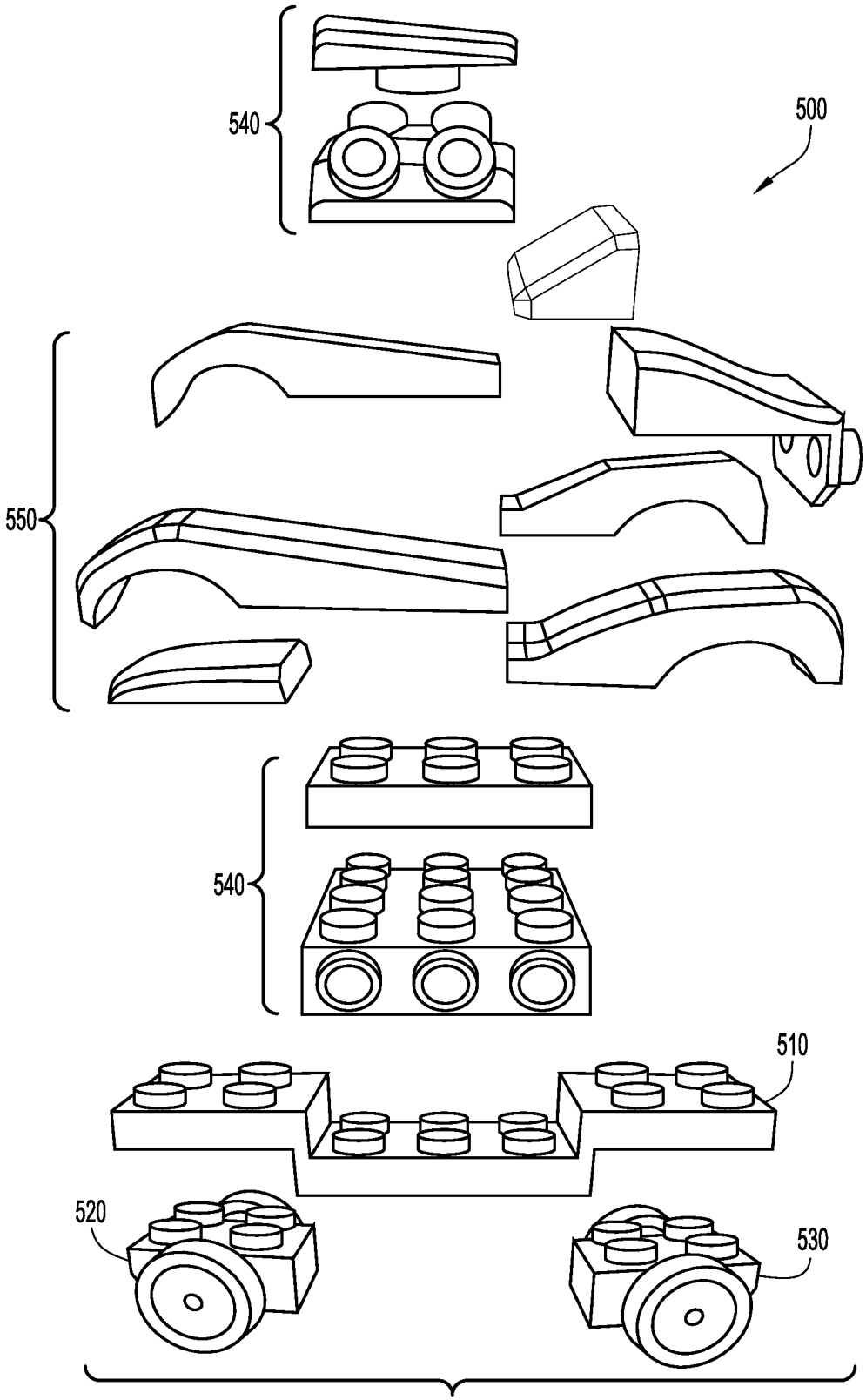
FIG. 13 shows an exploded view of the toy vehicle of FIGS. 11-12.

Referring first to FIGS. 11-13, a toy vehicle 500 is shown from top, bottom and exploded perspectives, respectively. As best seen in FIG. 13, toy vehicle 500 includes a U-shaped chassis 510 with a first wheel base 520 and second wheel base 530 coupled thereto. However, the wheel bases or assemblies 520, 530 do not include connectors and are simply coupled to the chassis 510 via studs and receiving areas in the manner described above. Each of the aforementioned parts or pieces may be manufactured from plastic or metal, as desired, but in this particular embodiment, the chassis 510 is manufactured from metal and the remaining parts are plastic. Additionally, in order to render the toy vehicle more aesthetically pleasing, the vehicle also includes wheel covers 550 and an engine block 540 constructed from multiple building components. In other embodiments, vehicle 500 may include any desirable aesthetic features, each of which may be manufactured from plastic or metal as desired. In this particular embodiment, the toy vehicle 500 is sufficiently robust to repeatedly interact with high impact devices, like wheeled boosters, because chassis 510 is manufactured from metal and is substantially U-shaped, similar to chassis 100.

Figure 14:
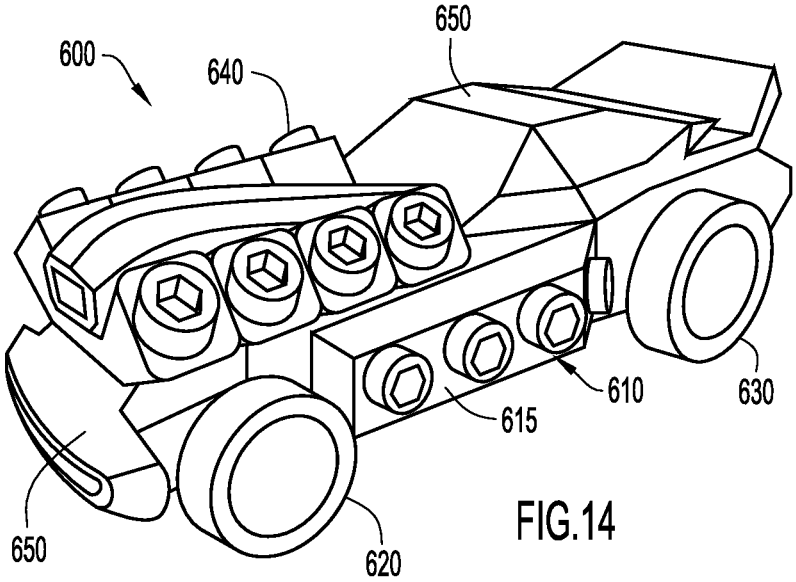
FIGS. 14-15 show a side perspective view and an exploded view, respectively, of another exemplary embodiment of a toy vehicle built from at least one building component of the present invention.
Figure 15:
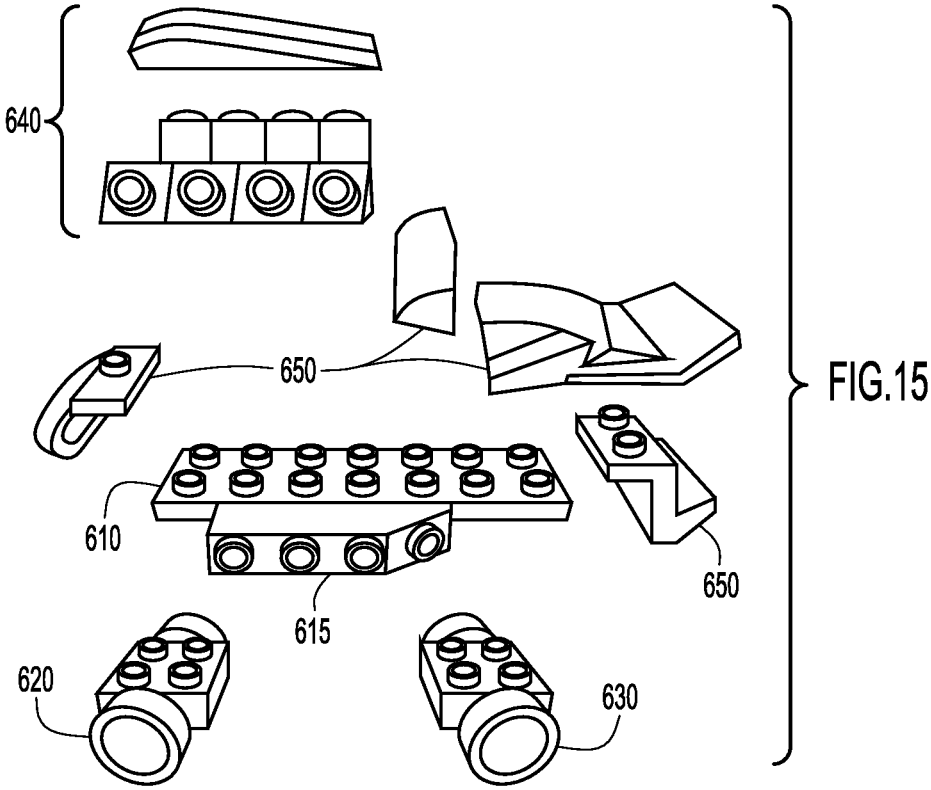

Now turning to FIGS. 14-15, another exemplary embodiment of a toy vehicle is shown from a side perspective and exploded view, respectively. As shown best in FIG. 15, toy vehicle 600 includes a chassis 610, a first wheel assembly 620, a second wheel assembly 630, an engine block 640, and various decorative coverings 650. In this embodiment, the chassis 610 is metal, the wheel assemblies 620, 630 are plastic, the engine block 640 is metal, and the coverings 650 are plastic. However, in this embodiment, the chassis 610 is a flat, metal plate with overhanging portions 615 that extend downwards from the sides of the flat plate. Consequently, the wheel assemblies 620, 630—which are substantially flatter than those of other embodiments are still laterally supported by the chassis 610 at their wheels via the overhanging portions 615. Moreover, the distance that the assemblies 620, 630 extend away from chassis is minimized by the inclusion of thin wheel assemblies 620, 630. Regardless, the chassis 610 still provides the wheel assemblies 620, 630 with additional support (compared to a strictly flat plate) by providing overhanging portions 615 which substantially extend between the wheels included on the first and second wheel assemblies 620, 630. The toy vehicle 600 with chassis 610 is exemplary of a gravity-based toy vehicle 600.

Moreover, and referring now to FIGS. 1-15 generally, in other embodiments, either one of the aspects that renders toy vehicles 600, 700, as well any other aspect of building components of the present invention described herein, may render a toy vehicle constructed from at least one building component of the present invention sufficiently robust for repeated use with wheeled boosters, among other devices.

Referring to FIGS. 16-19, several embodiments of a wheel mounting component according to the present invention. A wheel mounting component is used to mount a pair of wheels to other building components that collectively form a toy vehicle. In one embodiment, the wheel mounting component is formed by two portions that are coupled together about an axle to which wheels are connected. The axle is captured between the two portions and is mounted for rotation therebetween.

Referring to FIGS. 16 and 17, in one embodiment, a wheel mounting component 700 includes an upper portion 710 that is coupleable to a lower portion 750 via welding (such as sonic welding), an adhesive, and/or interconnecting parts. The upper portion 710 includes an upper side 712 and a lower side 714 and side walls or surfaces 720 that extend around the perimeter of the upper portion 710. Extending upwardly from the upper side 712 are posts 716 and a centrally located connector 718. In one embodiment, the posts 716 and the connector 718 extend upwardly from the upper side 712 generally at the same height. The lower portion 750 has an upper side 752, a lower side 754, and a groove 756 that extends across the upper side 752 from one side to another side. The lower side 754 of the lower portion 750 has a receptacle or receiving area that is configured to receive posts from another building component.

As shown in FIG. 16, a wheel assembly 800 includes a pair of wheels 802 and 804 that are connected to opposite ends of an axle 806. The axle 806 can be positioned between the grooves 722 and 756 of the upper and lower portions 710 and 750. When the upper portion 710 is coupled to the lower portion 750, the axle 806 is captured or secured between the portions 710 and 750. When the portions 710 and 750 are coupled, one or more building components can be connected to one or more of the posts 716 and the connector 718.

Referring to FIG. 18, another embodiment of a wheel mounting component is illustrated. In this embodiment, the wheel mounting component 770 includes an upper portion 772 and a lower portion 780. The upper portion 772 has posts 774 and a connector 776 similar to upper portion 710 illustrated in FIGS. 16 and 17. Extending downwardly from the upper portion 772 are posts 778 that are sized to fit into receptacles 782 in the lower portion 780. The posts 778 and receptacles 782 are configured for a friction fit connection that holds the upper portion 772 and the lower portion 780 together. An adhesive can be used to secure the posts 778 and the receptacles 782 together as well.

Referring to FIG. 19, another embodiment of an upper portion of a wheel mounting component is illustrated. In this view, the lower surface 792 of the upper portion 790 is illustrated. As shown, the lower surface 792 includes a ridge or wall 796 that extends around the perimeter of the edge of the upper portion 790. Similarly, a corresponding lower portion includes a ridge or wall that can be positioned adjacent to ridge 796. The ridges can be sonic welded together to secure the upper and lower portions together with the axle located therebetween.

While the invention has been illustrated and described in detail and with reference to specific embodiments thereof, it is nevertheless not intended to be limited to the details shown, since it will be apparent to one skilled in the art that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims. For example, a building component of the present invention can be of any size and shape.

It is also to be understood that building components of the present invention, or portions thereof may be fabricated from any suitable material, insofar as those parts or portions specified as being metal may be manufactured from any desired metal or combination of materials exhibiting metal like properties and those specified as being plastic may be manufactured from any desired plastic or combination of materials exhibiting plastic like properties. Other portions or parts of the present invention may be manufactured from any combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof. For example, the material comprising the building component 50 is not limited to that illustrated herein, and may include any desirable metal (e.g., aluminum or steel).

Finally, it is intended that the present invention cover the modifications and variations of this invention that come within the scope of the appended claims and their equivalents. For example, it is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

It is also to be understood that the term "building component" is used herein to refer to any article or item with studs and receptacles. The quantity of studs and receptacles of building components can vary from component to component. In addition, the shape and configuration of the building components can vary as well. The term "building component" is not limited to articles or items which are block-shaped. For example, while one embodiment of a building component according to the present invention is a rectangular parallelepiped, other embodiments of the building component may be flat and/or arcuate. A flat building component may be referred to alternatively as a plate.

What is claimed:

1. A toy vehicle constructed from building components, comprising:

a chassis including a main body, wherein the chassis is a die cast building component comprising:

at least one stud extending from a top surface of the chassis;

at least one receiving area included in a bottom surface of the chassis; and a first aperture and a second aperture each extending through the top surface and the bottom surface of the chassis;

a first wheel assembly including at least one stud and a first connector, each of the at least one stud and the first connector extending upward from a top surface of the first wheel assembly; and a second wheel assembly including at least one stud and a second connector, each of the at least one stud and the second connector extending upward from a top surface of the second wheel assembly, wherein the first wheel assembly is coupled to the chassis by inserting the first connector through the first aperture and coupling the at least one stud of the first wheel assembly to the at least one receiving area of the chassis, the second wheel assembly is coupled to the chassis by inserting the second connector through the second aperture and coupling the at least one stud of the second wheel assembly to the at least one receiving area of the chassis; and wherein the first and second wheel assemblies are laterally aligned with the chassis when coupled thereto.

2. The toy vehicle of claim 1, wherein the chassis is formed of zinc.

3. The toy vehicle of claim 1, wherein the first connector, the second connector, the first aperture, and the second aperture are each cross-shaped.

4. The toy vehicle of claim 1, wherein a portion of the first connector extends above the top surface of the chassis when the first wheel assembly is coupled to the chassis, and a portion of the second connector extends above the top surface of the chassis when the first wheel assembly is coupled to the chassis, so that coupling a building block to the top surface of the chassis above the first aperture secures the portion of the first connector within the building block and coupling the building block to the top surface of the chassis above the second aperture secures the portion of the second connector within the building block.

5. The toy vehicle of claim 4, wherein the building block comprises:

an annular interior wall that extends downwardly from a bottom surface of the building block and is configured to secure the portion of the first connector or the portion of the second connector therein when the at least one stud of the chassis is secured around the interior wall.

6. The toy vehicle of claim 1, wherein the chassis provides at least one offset coupling configuration.

7. The toy vehicle of claim 6, wherein the main body further comprises:

a first flange including a first elevated portion and a first elongate member;

a second flange including a second elevated portion and a second elongate member; and a central portion including a first end and a second end, the first flange being coupled to the central portion at the first end via the first elongate member such that first elevated portion is disposed at a distance above the central portion, the second flange being coupled to the central portion at the second end via the second elongate member such that the second elevated portion is disposed at a distance above the central portion, wherein the first and second elevated portions are parallel with the central portion.

8. A toy vehicle constructed from building components, comprising:

a first building component providing a chassis, the first building component comprising:

a main body including a top surface and a bottom surface;

at least one first stud extending from the top surface in a first direction;

a first plurality of receiving areas included in the bottom surface; and two or more apertures extending through the main body in a direction parallel to the first direction;

a second building component including a first wheel assembly and at least one second stud and a first connector extending from a top surface of the second building component;

a third building component including a second wheel assembly and at least one third stud and a second connector extending from a top surface of the third building component; and one or more fourth building components, each fourth building component including a second plurality of receiving areas and an annular interior wall, wherein:

the second plurality of receiving areas are configured to mate with the at least one first stud of the first building component;

the at least one second stud and the at least one third stud of the second and third building components are configured to be secured within the first plurality of receiving areas of the first building component; and the first connector and the second connector are each configured to be secured within the annular interior wall of one of the one or more fourth building components while extending through the two or more apertures of the first building component.

9. The toy vehicle of claim 8, wherein the first and second wheel assemblies are laterally aligned with the chassis when coupled thereto.

10. The toy vehicle of claim 8, wherein any portion of the first connector and the second connector extending above the top surface of the first building component is configured to be secured within the annular interior wall of one of the one or more fourth building components.

11. The toy vehicle of claim 8, wherein the first building component is a die cast building component.

12. The toy vehicle of claim 8, wherein the first connector and the second connector each have a cross-shaped cross section.

13. The toy vehicle of claim 8, wherein the at least one second stud of the second building component includes a first cluster of four studs arranged in a two-by-two grid, the at least one third stud of the third building component includes a second cluster of studs arranged in a two-by-two grid, the first connector is disposed centrally between the first cluster, and the second connector is disposed centrally between the second cluster.

14. The toy vehicle of claim 8, wherein securing the second building component and third building component to the first building component by securing the at least one second stud and the at least one third stud in the first plurality of receiving areas of the first building component and securing the first connector and second connector in the annular interior walls of fourth building components that are coupled to the top surface of the first building component while the first connector and second connector extend through apertures of the two or more apertures provides a connection that is robust enough to absorb stresses and forces from repeated use with wheeled boosters.

15. The toy vehicle of claim 8, wherein the first wheel assembly includes a first pair of wheels extending laterally from opposite sides of the second building component and the second wheel assembly includes a second pair of wheels extending laterally from opposite sides of the third building component.

* * * * *